US005949741A

United States Patent [19]

Piquette

[11] Patent Number: 5,949,741

[45] Date of Patent: Sep. 7, 1999

[54] DUAL-SECTION PUSH-PULL UNDERWATER PROJECTOR

[75] Inventor: Jean C. Piquette, Portsmouth, R.I.

[73] Assignee: The United States of America as represented by the Secretary of the Navy, Washington, D.C.

[21] Appl. No.: 09/226,627

[22] Filed: Dec. 21, 1998

[51] Int. Cl.[6] ..... H04R 17/00

[52] U.S. Cl. ..... 367/161; 310/337; 367/141

[58] Field of Search ..... 367/160, 161, 367/165, 141; 310/337

[56] References Cited

U.S. PATENT DOCUMENTS

| | | | |
|---|---|---|---|
| 3,725,856 | 4/1973 | Chervenak | 367/141 |
| 4,878,207 | 10/1989 | Jandera et al. | 367/155 |
| 4,964,106 | 10/1990 | Bromfield | 367/165 |
| 4,970,706 | 11/1990 | Tocquet et al. | 367/158 |
| 5,345,428 | 9/1994 | Arnold et al. | 367/165 |
| 5,359,252 | 10/1994 | Swift et al. | 310/328 |
| 5,493,165 | 2/1996 | Smith et al. | 310/328 |

*Primary Examiner*—Ian J. Lobo

*Attorney, Agent, or Firm*—Michael J. McGowan; Prithvi C. Lall; Michael F. Oglo

[57] ABSTRACT

The present invention relates to an underwater acoustic projector comprising a housing formed from a rigid material, a fixed plate secured to the housing, a first annular electrostrictive ring and a second annular electrostrictive ring positioned on one side of the fixed plate, and a third annular electrostrictive ring and a fourth annular electrostrictive ring positioned on a second side of the fixed plate. The first and second annular rings are separated by a first moving plate, while the third and fourth annular rings are separated by a second moving plate. The annular rings are formed from lead magnesium niobate or lead magnesium niobate-lead titanate and are wired for dual push-pull operation for reducing the non-linearity of the response of the annular rings.

10 Claims, 2 Drawing Sheets

DUAL-SECTION PUSH-PULL UNDERWATER PROJECTOR

STATEMENT OF GOVERNMENT INTEREST

The invention described herein may be manufactured and used by or for the Government of the United States of America for governmental purposes without the payment of royalties thereon or therefor.

BACKGROUND OF THE INVENTION

1. Field of the Invention

The invention relates to underwater acoustic projectors and is directed more particularly to a projector of the type commonly referred to as a "push-pull" acoustic projector.

2. Description of the Prior Art

Acoustic projectors typically are used to produce high-power low-frequency sounds in the ocean or other water body. It generally is desired to be able to generate hundreds of watts of omnidirectional acoustic power at frequencies below 1000 Hz., with a device that can be deployed from an aircraft, surface vessel, or submarine.

In order to create high-power acoustic tones in water at low frequencies, a device must be able to produce large volume displacements. The volume displacement is the integral of the normal displacement of a radiating area, taken over that area. Therefore, an acoustic projector must have a large radiating area, or a large displacement, or both. It is beneficial to have a projector with an output that varies linearly with the projector input.

The term "push-pull" as used herein and in the appended claims refers to a mode of operation of a pair of electrostrictive annular rings, in which the rings are in abutting relation to one and the other faces of a plate. The rings operate in unison, but oppositely, such that one ring "pushes" the plate, while the other ring simultaneously "pulls" the plate. Such an arrangement is commonly referred to as a "push-pull" projector, or transducer.

U.S. Pat. No. 3,725,856 to Chevenak illustrates a push-pull transducer in which a driver plate is not attached to the walls of a hollow cylinder formed by a plurality of walls.

In recent years, consideration has turned to electrostrictive rings of lead magnesium niobate (PMN) and lead magnesium niobate-lead titanate (PMNPT) ceramics. For example, U.S. Pat. No. 5,359,252 to Swift et al. discloses an actuator in which a stack of lead magnesium niobate crystals are free to expand longitudinally within a cylindrical casing to act on a piston. U.S. Pat. No. 5,493,165 to Smith et al. disclose a driver for electrostrictive actuators in which rings of lead magnesium niobate are interleaved with electrode rings to form a stack.

Lead magnesium niobate and lead magnesium niobate-lead titanate have recently gained wide interest in the underwater acoustics transduction community due to the propensity of these materials to exhibit large strains at relatively modest electric field levels. One difficulty with these materials, however, is that the observed strains exhibit a nonlinear response to the applied drive voltage. That is, harmonics of the drive frequency appear in the response of the material. However, the nonlinearity of both PMN and PMNPT is known to exhibit a primarily quadratic response of the strain to the applied drive. See K. M. Rittenmeyer, "Electrostrictive Ceramics for Underwater Transducer Applications," J. Acoust. Soc. Am. 95, pp. 849–856 (1994). This quadratic behavior has been shown to permit the application of a revised Hunt electrostatic transducer model (F. V. Hunt, *Electroacoustics*, John Wiley & Sons, New York, 1954, pp. 176–177) to understanding the behavior of a PMN or PMNPT-based transducer. See J. C. Piquette, "A Fully Mechanical Transducer Model With Application to Generalizing the Non-Linear Hunt Electrostatic Transducer for Harmonic and Transient Suppression," J. Acoust. Soc. Am. 98, pp. 422–430 (1995). Since PMN and PMNPT behave in a manner similar to a Hunt electrostatic transducer, concepts applicable to linearizing an electrostatic transducer are also applicable to developing a linear underwater projector which utilizes either a PMN and/or PMNPT active element. Applicant has recognized the concept of push-pull electrostatic loudspeaker is applicable to the development of a push-pull underwater projector using PMN and/or PMNPT. It also has been recognized by applicant that since the properties of PMN are sensitive to the operating environmental conditions, it is also important to correct the operation of a PMN-based projector for variations in environmental conditions.

The operation of an electrostatic loudspeaker is based on the push-pull principle. This principle produces cancellation of nonlinear responses that arise from a quadratic nonlinearity. The push-pull electrostatic loudspeaker operates in a mode which attempts to maintain a constant charge on a pair of balanced moving plate capacitors which share a common moving plate. It has been recognized by applicant that an underwater projector using a PMN and/or PMNPT active element can also be designed to take advantage of the push-pull concept, and hence can also produce a linearized output in a manner similar to an electrostatic loudspeaker.

SUMMARY OF THE INVENTION

Accordingly, it is an object of the present invention to provide an underwater acoustic projector utilizing electrostrictive drive rings of PMN and providing a linearized acoustic energy output.

A further object of the present invention is to provide an underwater acoustic projector as above whose operation is more hydrostatic-pressure insensitive.

Yet a further object of the present invention is to provide an underwater acoustic projector as above which results directly in a highly desirable monopole radiation.

The foregoing objects are attained by the underwater acoustic projector of the present invention.

An underwater acoustic projector in accordance with the present invention comprises a housing formed from a rigid material, a fixed plate secured to the housing, a first annular electrostrictive ring and a second annular electrostrictive ring positioned on one side of the fixed plate, and a third annular electrostrictive ring and a fourth annular electrostrictive ring positioned on a second side of the fixed plate. The first and second annular rings are separated by a first moving plate, while the third and fourth annular rings are separated by a second moving plate. The annular rings are formed from lead magnesium niobate or lead magnesium niobate-lead titanate and are wired for dual push-pull operation for reducing the non-linearity of the response of the annular rings.

Other details of the underwater acoustic projector of the present invention, as well as other objects and advantages attendant thereto, are set forth in the following description and drawings.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT(S)

Figure 1:
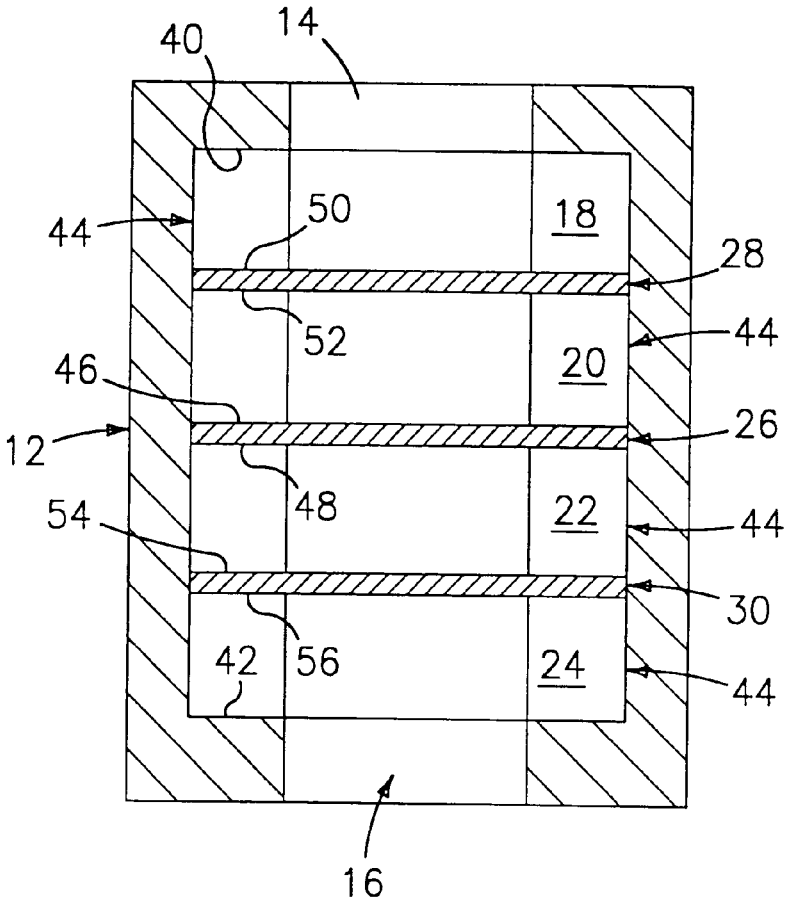
FIG. 1 is a sectional view of one form of an underwater acoustic projector illustrative of an embodiment of the invention.
Figure 2:
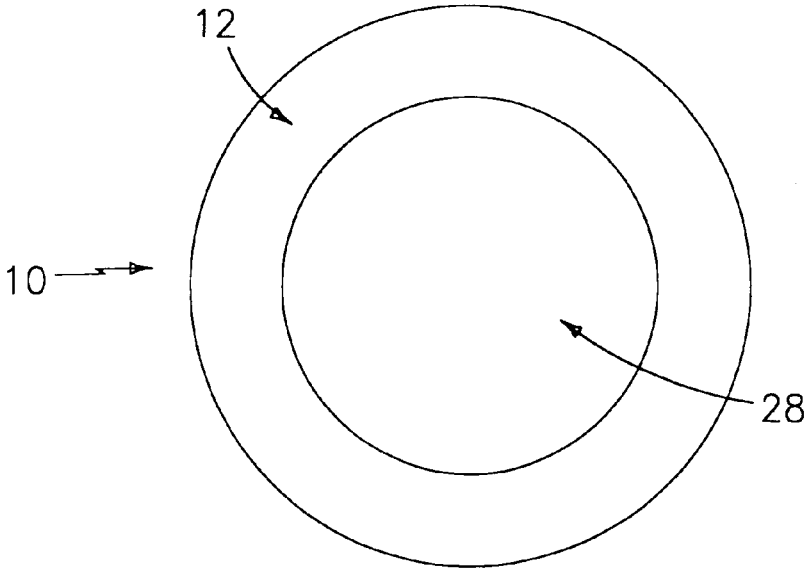
FIG. 2 is a front sectional view of the projector of FIG. 1.

Referring to FIGS. 1 and 2, it will be seen that the illustrative underwater acoustic projector 10 has a housing 12 formed from a rigid metallic material such as stainless steel. The housing 12 includes spaced apart apertures 14 and 16 to place the interior components of the projector 10 in contact with the fluid medium, i.e., seawater, into which the acoustic radiation generated by the projector flows.

A plurality of annular, electrostrictive rings 18, 20, 22 and 24 of PMN-material, preferably lead magnesium niobate or lead magnesium niobate-lead titanate, are positioned within the housing 12. The rings 18, 20, 22 and 24 are wired for dual "push-pull" operation with annular rings 18 and 20 forming one push-pull pair and annular rings 22 and 24 forming a second push-pull pair. The flat surfaces 40 and 42 of rings 18 and 24 are in contact with and bonded to the housing 12 so as to prevent motion of these surfaces. Thus, it is important that the housing 12 be sufficiently rigid to prevent motion of the flat surfaces 40 and 42 of the rings 18 and 24. The circumferential portions 44 of the rings 18 and 24 and the rings 20 and 22 are left unbonded so as to not inhibit motion.

The acoustic projector 10 further includes a flat plate 26 which is fixed in position in the housing 12. The plate 26 may be fixed in place using any suitable means known in the art and may be formed from any suitable rigid material, such as stainless steel. The surfaces 46 and 48 of the PMN annular rings 20 and 22 which are in contact with the plate 26 are bonded to it, again to prevent motion, while the circumferential portions are left unbonded.

The acoustic projector 10 further includes two moving plates 28 and 30. Moving plate 28 is positioned between the annular rings 18 and 20. The flat surfaces 50 and 52 of the annular rings 18 and 20 in contact with the moving plate 28 are bonded to it. In a similar fashion, moving plate 30 is positioned between the annular rings 22 and 24 and the flat surfaces 54 and 56 of the rings 22 and 24 in contact with the plate 30 are bonded to it. In operation, the moving plates 28 and 30 are free to move in response to the forces applied to it by each PMN ring.

The cavities between plates 28 and 26, and between plates 30 and 26 are filled with a fluid, such as oil, to reduce hydrostatic sensitivity.

The acoustic projector 10 is wired for dual push-pull operation. This means that when the sections defined by PMN rings 18 and 24 contract, the sections defined by PMN rings 20 and 22 expand, and vice versa. Each of the two moving plates 28 and 30 represent radiating faces of the projector 10. When operated as described herein, the moving plates 28 and 30 move away from or toward the fixed plate 26 in unison, thus producing monopole radiation.

An important factor in the successful operation of the projector of the present invention is that it be driven with a power amplifier operated in the constant-current mode. The cancellation of harmonics that results from driving a nonlinear device in a push-pull manner occurs only when the device exhibits a quadratic nonlinearity. The nonlinearity of PMN is quadratic in the charge, but not in the voltage. Thus, the present device will only operate in a linear manner when the power amplifier is driven in the constant-current, i.e., constant-charge, mode.

Figure 3:
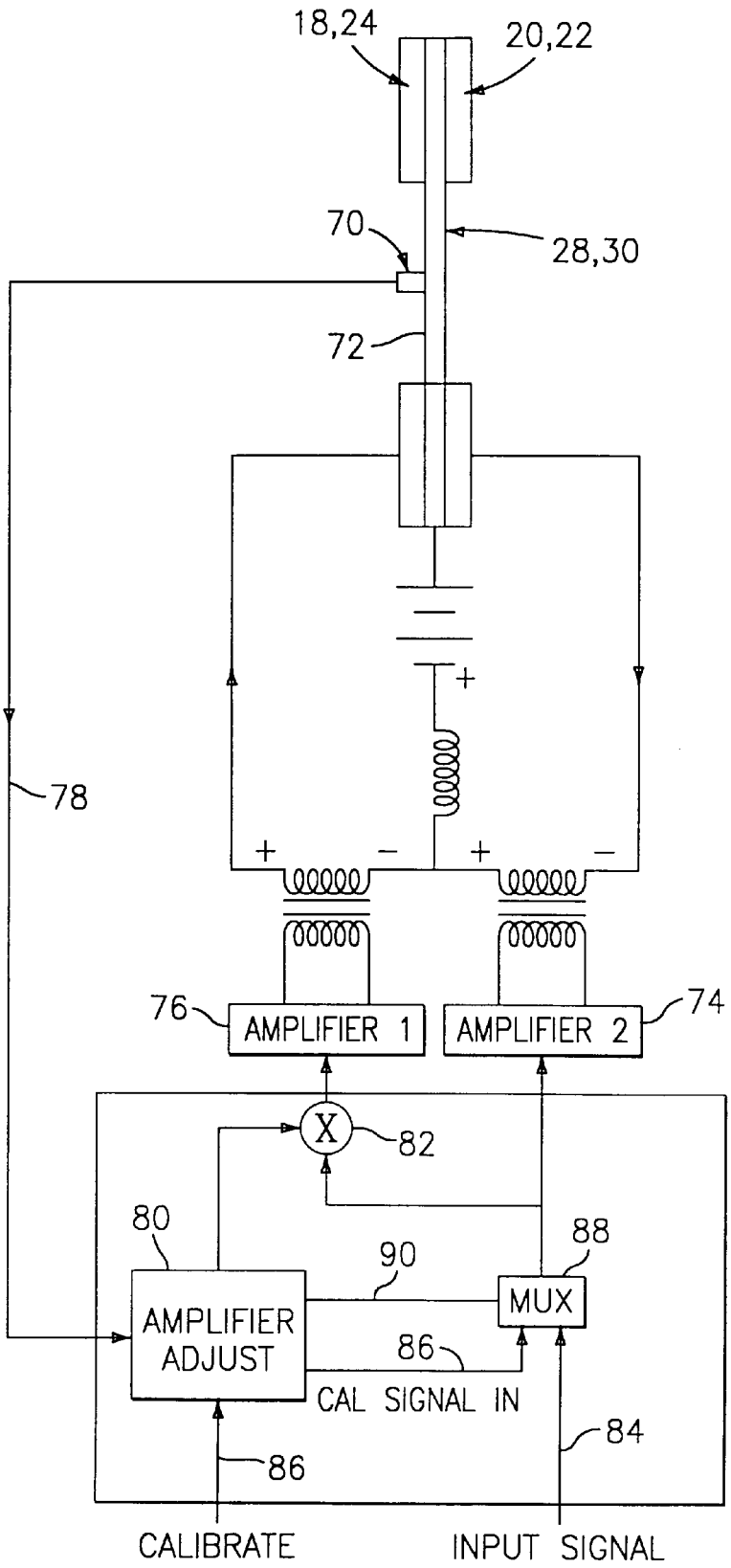
FIG. 3 is a schematic diagram illustrative of an electrical drive circuit for each push-pull pair in the projector of FIGS. 1 and 2.

FIG. 3 illustrates a circuit which can be used for driving each push-pull pair in the acoustic projector 10. To compensate for any lack of balance, there is provided an accelerometer 70 adjacent a face 72 of each of moving plates 28 and 30. The accelerometers are adapted to detect the waveform of the drive currents supplied to the plate 28 by the rings 18 and 20 and to the plate 30 by the rings 22 and 24, and thereby applied to rings 18, 20, 22, and 24, by constant-current power amplifiers 74, 76, or other signal sources. It is important that constant current amplifiers be used, and not constant voltage power amplifiers, since the response of PMN bears a quadratic relationship to the current, but not the voltage. Each accelerometer 72 is operative to provide feedback inputs through line 78 to an amplifier adjust control box 80. The control box 80 effects selection of an appropriate multiplier 82 for an input signal 84. If the drive rings 18, 20, 22, and 24 in each pair are perfectly balanced, the multiplier selected is 1.

To set up a multiplier, the projector 10 is placed in its operative environment and a calibrate signal 86 is entered in the control box 80. The control box 80 forwards the calibrate signal to an input multiplexer 88, and shuts off any input signal 84. A sinusoidal test tone 90 is then sent through the multiplexer 88 and the constant-current power amplifiers 74, 76 to the rings 18, 20, 22 and 24. The signals returning through line 78 from each accelerometer 70 are monitored by control box 80 which adjusts the multiplier 82 until a second harmonic of the acceleration of the plates 28, 30 is a minimum. The multiplier value is then stored in a nonvolatile memory and used for all subsequent operations of the projector 10 until the next calibration is undertaken. A calibration process takes about five seconds or less. Once the multiplier is set, the constant-current power amplifiers 74, 76 produce substantially identical sinusoidal signals of opposite polarity and unequal in amplitude, such that the waveshape of an acoustic signal produced by each plate 28, 30 becomes that of a pure monofrequency sinusoid.

In a preferred embodiment, the acoustic projector 10 is wired so that a DC bias appears across all four PMN annular-ring sections depicted in FIG. 1. Each of the two moving plates 28 and 30 is biased with the same polarity. The fixed plate 26 and the housing 12 are also biased with the same polarity, but opposite to that of the moving plates. For example, if the moving plates are biased positively, then the housing and the fixed plate would be biased negatively. Electrical insulation (not shown) would have to be applied to each moving plate 28 and 30 to prevent electrical shorting with the housing 12 through a conductive medium, such as seawater, in which the projector 10 would be immersed when operated as intended. If desired, the entire housing 12 could also receive a treatment of electrical insulation.

An AC signal voltage would be wired so that the total voltage (DC+AC) across the rings 18 and 24 would decrease at the same time that the total voltage across rings 20 and 22 would increase, and vice versa as the AC signal reverses polarity. The DC bias source would have to be wired to the two moving plates through a protective resistor sufficiently large to prevent changes in the total charge on these moving plates. This is accomplished by choosing a protective resistance such that the RC time constant computed for it and the capacitance of the device is large compared with the period of the AC signal. Similarly, protective capacitances would have to be wired in series with the AC signal source(s) to prevent feed-through of the DC bias into the AC amplifier (s).

The constant-current amplifiers 74, 76 are standard amplifier devices that provide as output an amplified version of an input current signal. An example is the model L6 amplifier manufactured by Instruments, Inc. of San Diego, Calif. This device can be operated as a current amplifier, as required here, or as either a voltage or resistive source, through the operation of a selector switch on the amplifier's front panel.

An important feature of the acoustic projector of the present invention is the fact that this device contains no air cavities. Hence, its operation is much more hydrostatic-pressure insensitive. Moreover, the dual push-pull configuration of the present device results directly in the highly desirable monopole radiation.

Typical dimensions of the stack described herein would be approximately 6 inches total stack height for each of the two stacks involved in the push-pull design. The number of PMN rings in each stack could readily be increased to enhance performance if required. Typical lateral dimensions would involve approximately a 3-inch diameter of the stack. Design goals of interest would produce a device that operates in the frequency range of 1–10 Khz.

It is apparent that there has been provided in accordance with the present invention a dual-section push-pull underwater projector which fully satisfies the means, objects and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An underwater acoustic projector comprising:

a housing formed from a rigid material;

fixed plate secured to said housing;

a first annular electrostrictive ring and a second annular electrostrictive ring positioned on one side of said fixed plate;

a third annular electrostrictive ring and a fourth annular electrostrictive ring positioned on a second side of said fixed plate;

said first and second annular rings being separated by a first moving plate;

said third and fourth annular rings being separated by a second moving plate; and means for producing a monopole radiation by causing said first and second movable plates to move away from or toward said fixed plate in unison.

2. The underwater acoustic projector of claim 1, wherein said means for producing a monopole radiation comprises said annular rings being wired for dual push-pull operation.

3. The underwater acoustic projector of claim 1, wherein said annular rings are formed from a material selected from a group consisting of (1) lead magnesium niobate and (2) lead magnesium niobate-lead titanate.

4. The underwater acoustic projector of claim 1, wherein said housing and said fixed plate are formed from a rigid metallic material.

5. The underwater acoustic projector of claim 4, wherein said metallic material comprises stainless steel.

6. The underwater acoustic projector of claim 1, wherein flat surfaces of said first and fourth annular rings in contact with said housing are bonded to said housing.

7. The underwater acoustic projector of claim 1, wherein surfaces of the second and third annular rings in contact with said fixed plate are bonded to said fixed plate.

8. The underwater acoustic projector of claim 1, wherein the flat surface of the first and second annular rings in contact with the first moving plate are bonded to the first moving plate.

9. The underwater acoustic projector of claim 8, wherein the flat surfaces of the third and fourth annular rings in contact with the second moving plate are bonded to the second moving plate.

10. The underwater acoustic projector of claim 1, wherein said means for producing a monopole radiation further comprises a power amplifier operated in a constant current mode for driving said projector.

* * * * *